US006698441B1

(12) United States Patent
Zheng

(10) Patent No.: US 6,698,441 B1
(45) **Date of Patent: *Mar. 2, 2004**

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 66 days.

This patent is subject to a terminal disclaimer.

(21) Appl. No.: 09/717,620

(22) Filed: Nov. 21, 2000

Related U.S. Application Data

(63) Continuation-in-part of application No. 09/633,947, filed on Aug. 8, 2000, now Pat. No. 6,269,826, which is a division of application No. 09/162,086, filed on Sep. 29, 1998, now abandoned, which is a division of application No. 08/859,876, filed on May 21, 1997, now Pat. No. 5,816,279, which is a division of application No. 08/627,875, filed on Apr. 3, 1996, now Pat. No. 5,664,596, which is a continuation of application No. 08/281,369, filed on Jul. 27, 1994, now Pat. No. 5,560,385, which is a continuation-in-part of application No. 08/024,690, filed on Mar. 1, 1993, now Pat. No. 5,467,794, which is a continuation-in-part of application No. 07/764,784, filed on Sep. 24, 1991, now Pat. No. 5,301,705.

(51) Int. Cl.[7] ..... E04H 15/40; A63B 63/08

(52) U.S. Cl. ..... 135/126; 135/144; 135/117; 473/433; 473/472; 273/397

(58) Field of Search ..... 135/126, 128, 135/144, 143, 117, 130; 446/478, 487; 473/433, 472, 478, 197; 273/397, 400, 402, 407; 160/370.21, 135, 351

(56) References Cited

U.S. PATENT DOCUMENTS

| | | | | | |
|---|---|---|---|---|---|
| 2,936,771 | A | * | 5/1960 | Marchfield et al. | 135/148 |
| 3,408,071 | A | * | 10/1968 | Lundy | 473/421 |
| 3,913,598 | A | * | 10/1975 | Glutting et al. | 135/152 |
| 4,212,130 | A | * | 7/1980 | Walker | 446/111 |
| 4,632,138 | A | * | 12/1986 | Irwin | 135/143 |
| 4,815,784 | A | * | 3/1989 | Zheng | 160/329 |
| 4,825,892 | A | * | 5/1989 | Norman | 135/126 |
| 4,838,549 | A | * | 6/1989 | Woodall | 135/125 |
| 5,024,262 | A | | 6/1991 | Huang | |
| 5,038,812 | A | * | 8/1991 | Norman | 135/143 |
| 5,054,507 | A | * | 10/1991 | Sparks | 135/97 |
| D321,737 | S | * | 11/1991 | Lo | D21/201 |
| 5,137,044 | A | * | 8/1992 | Brady | 135/126 |
| 5,592,961 | A | * | 1/1997 | Chin | 52/113 |
| 5,800,067 | A | | 9/1998 | Easter | |
| 6,030,300 | A | | 2/2000 | Zheng | |
| 6,073,643 | A | | 6/2000 | Zheng | |
| 6,109,281 | A | | 8/2000 | Lowenthal | |

FOREIGN PATENT DOCUMENTS

DE 3344955 * 6/1985

* cited by examiner

*Primary Examiner*—Winnie Yip
(74) *Attorney, Agent, or Firm*—Raymond Sun

(57) ABSTRACT

A collapsible structure has a first panel, a second panel, and a third panel. Each panel has a foldable frame member having a folded and an unfolded orientation, with a fabric material covering portions of the frame member to form the panel when the frame member is in the unfolded orientation. One first side of the first panel is coupled to one side of the second panel, and one side of the third panel is coupled to the fabric of the second panel.

10 Claims, 5 Drawing Sheets

COLLAPSIBLE STRUCTURES

RELATED CASES

This is a continuation-in-part of Ser. No. 09/633,947, entitled "Collapsible Play Structures", filed Aug. 8, 2000, now U.S. Pat. No. 6,269,826 which is a division of Ser. No. 09/162,086, entitled "Collapsible Play Structures", filed Sep. 29, 1998, now abandoned, which is a division of Ser. No. 08/859,876, entitled "Collapsible Play Structures", filed May 21, 1997, now U.S. Pat. No. 5,816,279, which is a division of Ser. No. 08/627,875, entitled "Collapsible Play Structures", filed Apr. 3, 1996, now U.S. Pat. No. 5,664,596, which is a continuation of Ser. No. 08/281,369, entitled "Collapsible Play Structures", filed Jul. 27, 1994, now U.S. Pat. No. 5,560,385, which is a continuation-in-part of Ser. No. 08/024,690, entitled "Collapsible Shade Structure", filed Mar. 1, 1993, now U.S. Pat. No. 5,467,794, which is in turn a continuation-in-part of Ser. No. 07/764,784, entitled "Collapsible Shade Structure", filed Sep. 24, 1991, now U.S. Pat. No. 5,301,705, the entire disclosures of which are incorporated by this reference as though set forth fully herein.

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the structures to facilitate convenient storage and use.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. No. 5,467,794 (Zheng), U.S. Pat. No. 5,560,385 (Zheng), U.S. Pat. No. 5,778,915 (Zheng), U.S. Pat. No. 6,032,685 (Zheng), and U.S. Pat. No. 6,098,349 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, yet can use the same structure for camping.

Another example of collapsible objects include collapsible game and play structures, such as those illustrated in U.S. Pat. No. 5,722,446 (Zheng) and U.S. Pat. No. 5,816,954 (Zheng). These structures provide a multitude of game structures that can be enjoyed by children and adults indoors and outdoors.

SUMMARY OF THE DISCLOSURE

It is an object of the present invention to provide collapsible objects and structures that are different from those mentioned above, and which offer the user different variety of play and use.

In order to accomplish the objects of the present invention, the collapsible structure according to the present invention has a first panel, a second panel, and a third panel. Each panel has a foldable frame member having a folded and an unfolded orientation, with a fabric material covering portions of the frame member to form the panel when the frame member is in the unfolded orientation. One side of the first panel is coupled to one side of the second panel, and one side of the third panel is coupled to the fabric of the second panel. The collapsible structure according to the present invention can also include a fourth panel, with one side of the fourth panel coupled to a second side of the second panel.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
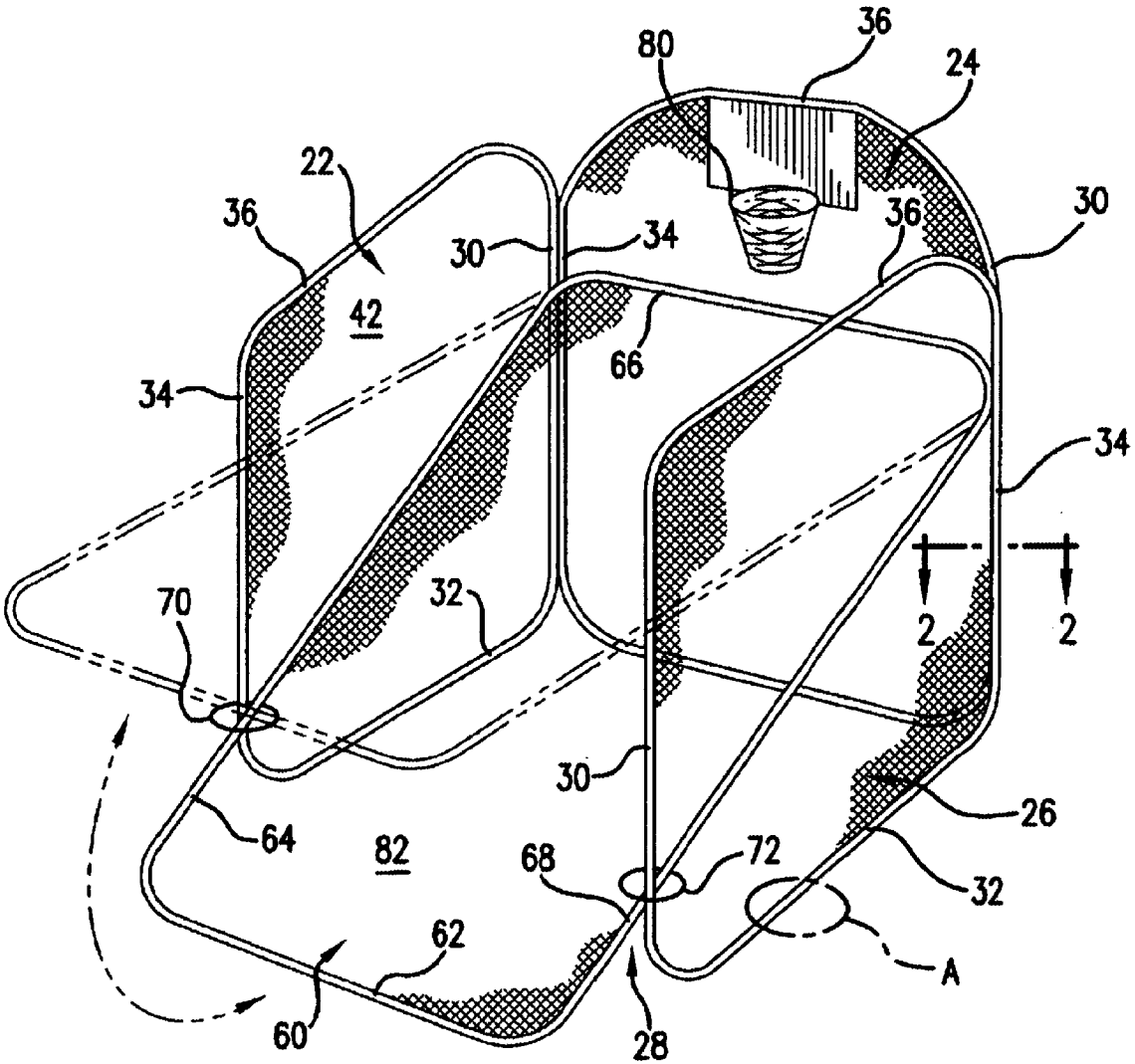
FIG. 1 is a perspective view of a collapsible structure according to one embodiment of the present invention.
Figure 1A:
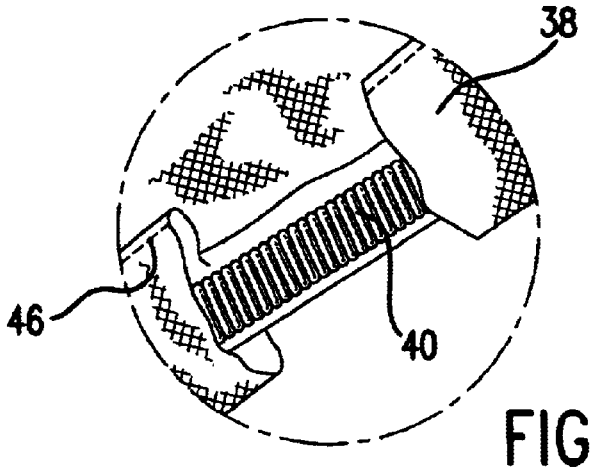
FIG. 1A is a partial cut-away view of the section A of the structure of FIG. 1 illustrating a frame member retained within a sleeve.

FIGS. 1 and 1A illustrate a collapsible structure 20 according to one embodiment of the present invention. The structure has three panels 22, 24 and 26 connected to each other to define an interior space 28. The three panels include two side panels 22, 26, and a rear panel 24. Each panel 22, 24, 26 has four sides, including a first side 30, a second side 32, a third side 34 and a fourth side 36. The first side 30 of the side panel 22 is hingedly coupled to the third side 34 of the adjacent rear panel 24, and the first side 30 of the rear panel 24 is hingedly coupled to the third side 34 of the other side panel 26. Even though each panel 22, 24, 26 is illustrated as having four sides, it is possible to configure any of these panels 22, 24, 26 with any shape having different number of sides, including sides that have varying degrees of curvature. For purposes of the present invention, a "side" can have varying degrees of curvature and is not restricted to merely a straight configuration. As a result, each side 30, 32, 34, 36 can be partially or completely curved.

Referring to FIG. 1A, each panel 22, 24, 26 has a continuous frame retaining sleeve 38 provided along and traversing the four edges of its four sides 30, 32, 34, 36. A continuous frame member 40 is retained or held within each frame retaining sleeve 38 to support each panel 22, 24, 26. Each sleeve 38 may be formed by folding a piece of fabric and applying a stitching 46. Only one frame member 40 is shown in FIG. 1A; the other frame members are not shown but are the same as frame member 40. The frame members 40 may be merely retained within the respective frame retaining sleeves 38, without being connected thereto. Alternatively, the frame retaining sleeves 38 may be mechanically fastened, stitched, fused, or glued to the frame members 40 to retain them in position.

The continuous frame members 40 may be provided in the form of one continuous loop, or may comprise a strip of material connected at both ends to form a continuous loop. The continuous frame members 40 are preferably formed of flexible coilable steel having a memory, although other materials such as plastics may also be used. The frame members should be made of a material which is relatively strong and yet is flexible to a sufficient degree to allow it to be coiled. Thus, each frame member 40 is capable of assuming two positions or orientations, an open or expanded position such as shown in FIG. 1, or a folded position in which the frame member is collapsed into a size which is much smaller than its open position (see FIG. 3E).

Fabric or sheet material 42 extends across each panel 22, 24, 26 and is held taut by the respective frame members 40 when in its open position. The fabric 42 for the corresponding panel 22, 24 or 26 is stitched to the sleeve 38. The fabric 42 can extend completely across the panel to entirely cover the space enclosed by the frame member 40, or can extend across selected portions of the space enclosed by the frame member 40. The term fabric is to be given its broadest meaning and should be made from strong, lightweight materials and may include woven fabrics, sheet fabrics or even films and meshed materials. For example, the fabric 42 in FIG. 1 is illustrated as being a meshed material. The fabric should be water-resistant and durable to withstand the wear and tear associated with rough treatment by children or outdoor use.

Figure 2A:
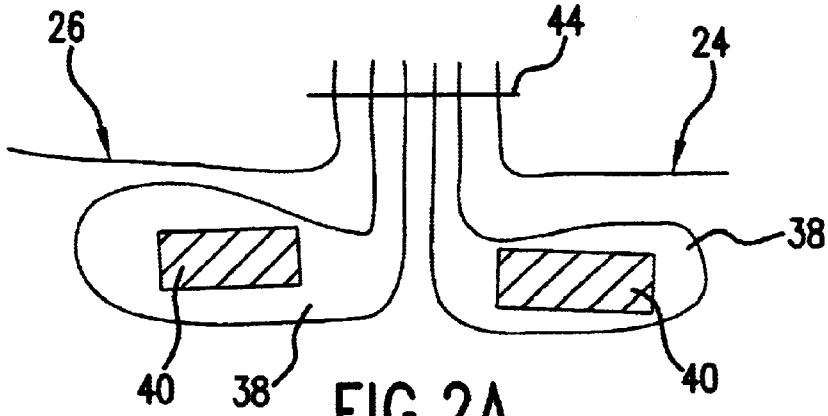
FIG. 2A is a cross-sectional view of one possible connection between two adjacent panels of the structure of FIG. 1 taken along line 2—2 thereof.

FIG. 2A illustrates one possible connection for connecting adjacent edges of two panels 24 and 26. The fabric pieces 42 are stitched at their edges to their respective sleeves 38 by a stitching 44. The stitching 44 also acts as a hinge for the panels 24 and 26 to be folded upon each other, as explained below. The connection for the other pair of adjacent edges (i.e., between panels 22 and 24) may be identical. Thus, the connections on the first side 30 and the third side 34 for the respective panels 22, 24, 26 act as hinge connections for connecting an adjacent panel.

The stitching 44 is essentially the same as stitching 46 illustrated in FIG. 1A, in that both stitchings 44 and 46 also operate to enclose the fabric material to form the sleeve 38. The difference is that stitching 44 extends along the first side 30 of panels 22 and 24 and the third side 34 of panels 24 and 26 (where a hinge connection is present) and also operates to attach adjacent panels, while stitching 46 merely extends along the second and fourth sides 32 and 36, and the third side 34 of panel 22 and the first side 30 of panel 26 (where there is no hinge connection).

Figure 2B:
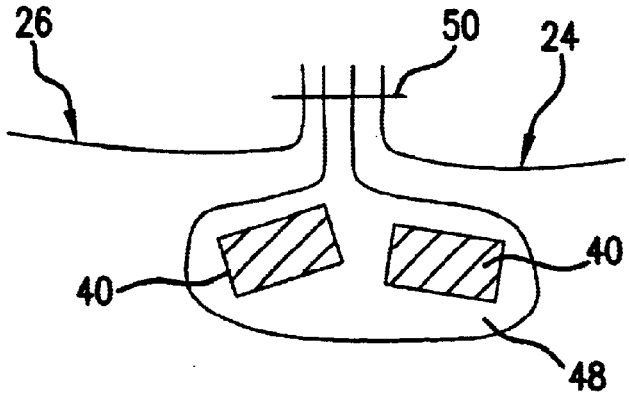
FIG. 2B is a cross-sectional view of another possible connection between two adjacent panels of the structure of FIG. 1 taken along line 2—2 thereof.

FIG. 2B illustrates a second possible connection for connecting adjacent edges of two panels 24 and 26. The frame retaining sleeves 38 at the first side 30 of panel 24 and the third side 34 of panel 26 converge at, or are connected to, one sleeve portion which interconnects panels 26 and 28 to form a singular frame retaining sleeve 48 which retains the frame members 38 for panels 24, 26. Sleeve 48 may be formed by providing a tubular fabric, or by folding a piece of fabric, and applying a stitching 50 to its edges to connect the sleeve 48 to the fabric 42 for panels 24, 26. Stitching 50 also acts as a hinge for the panels 24, 26. The connections for the three other pairs of adjacent edges may be identical.

An additional panel 60 can be positioned inside the interior space 28 defined by the panels 22, 24, 26. The panel 60 can have the same construction as any of the panels 22, 24, 26 described herein, and can be provided in any configuration with any number of sides, and in any size. For example, the panel 60 in FIG. 1 is illustrated as being longer than the side panels 22 and 26. In FIG. 1, panel 60 is illustrated as having four sides 62, 64, 66 and 68, with the side 66 hingedly coupled (e.g., by stitching) to the fabric 42 of the rear panel 24in a position or vertical level so that the panel 60 can be pivoted up and down inside the interior space 28. For example, the panel 60 can be positioned in a manner such that the first side 62 that is opposite from the third side 66 rests on the ground or surface. When in this position, the panel 60 is angled with respect to a horizontal surface.

Removable attachment mechanisms 70 and 72, such as opposing VELCRO™ pads, loops, ties, or straps, can be provided on the sides 64 and 68 of the panel 60, and along the sides 30 and 34 of the side panels 26 and 22, respectively, to couple the panel 60 to the side panels 22 and 26 at certain predefined positions. As an alternative, the side 66 can be removably coupled to the fabric 42 of the rear panel 24 using one of these removable attachment mechanisms, so that the panel 60 can be removed and the sides 30 and 34 of the side panels 26 and 22, respectively, can be coupled together via the removable attachment mechanisms 70 and 72 to form a three-sided enclosure defined by the three panels 22, 24, 26. The removable attachment mechanisms described herein may also define hinged connections such as when used for the side 66 and the fabric 42 of the rear panel 24.

The structure 20 in FIG. 1 can be used as a play structure by providing a hoop or basket 80 on the fabric 42 of the rear panel 24 on the interior-facing side of the fabric 42. With the panel 60 positioned in its angled orientation as shown in FIG. 1, a user can toss a ball through the hoop 80, and the ball will land on the fabric 82 of the angled panel 60. The panel 60 will function as a ramp to roll the ball down to the ground. Thus, the panel 60 provides a ball-return ramp for the structure 60. Although FIG. 1 illustrates the provision of a basket or hoop 80 as an amusement feature, it is possible to provide any other amusement features with any of the panels 22, 24, 26 or 60.

The panel 60 can also be used as a support mechanism to provide stability to the three panels 22, 24, 26. For example, without the panel 60, the three panels 22, 24, 26 may be susceptible to being tipped or toppled. However, by positioning and coupling the panel 60 between the three panels 22, 24, 26 at any vertical or angled level, the panel 60 imparts lateral support to minimize the possibility of tipping or toppling. This support can be further understood if one of the side panels, such as 26, were omitted. In other words, the structure 20 only needs to be provided with two panels, such as 22 and 24, since the panel 60 can be coupled to the two panels 22, 24 to provide sufficient stability to the resulting two-sided structure.

In addition, if the panel 60 is positioned at a generally horizontal orientation between the three panels 22, 24, 26 (as shown in phantom in FIG. 1), the panel 60 can even function as a shade or roof.

Although FIG. 1 illustrates a few possible uses and applications for the structure 20 as illustrated and described above, it will be appreciated by those skilled in the art that the basic structure 20 illustrated in FIG. 1, together with its modifications, can be used in numerous applications that are not necessarily limited to children and play.

Figure 3A:
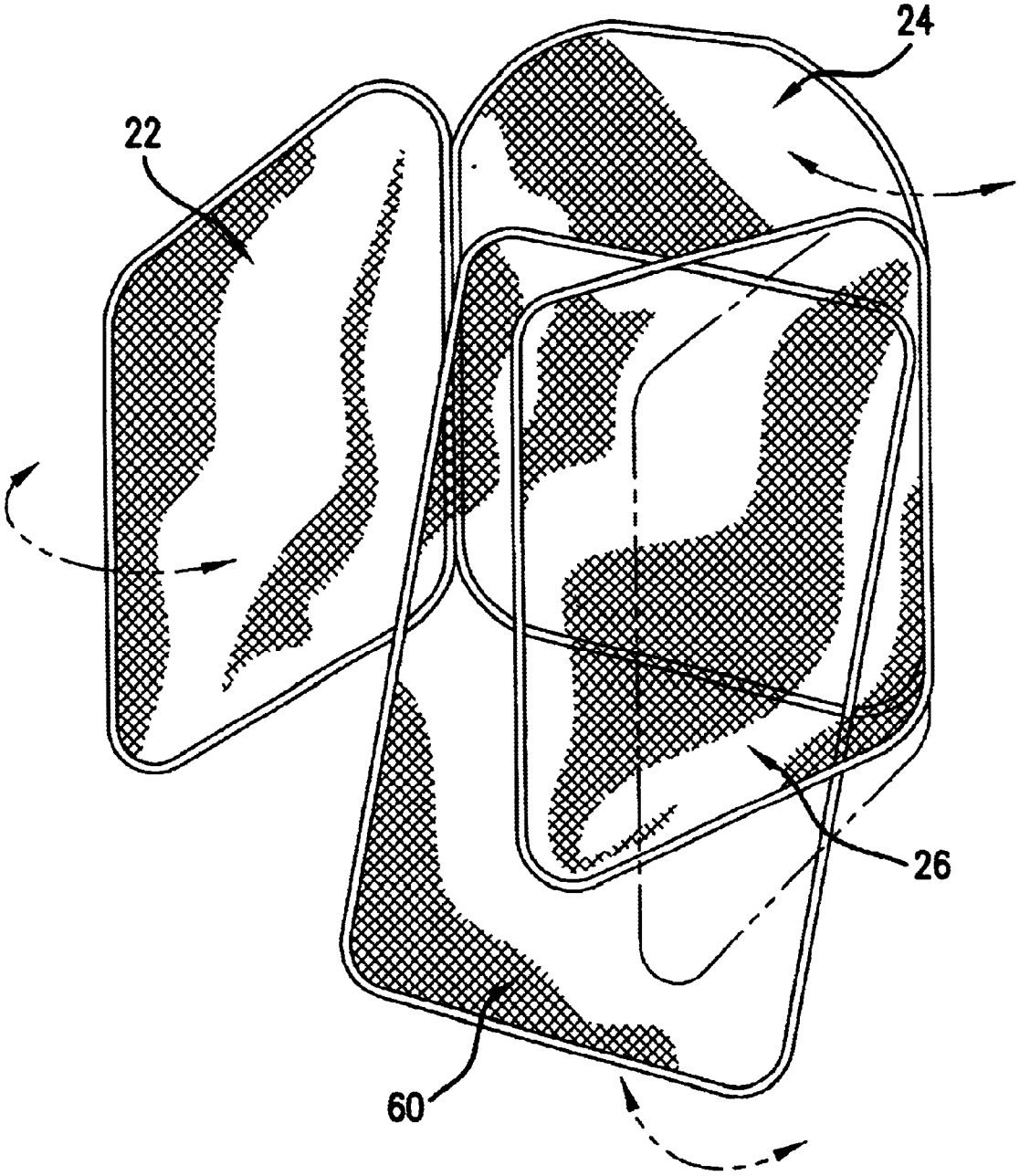
FIGS. 3(A) through 3(E) illustrate how the collapsible structure of FIG. 1 may be twisted and folded for compact storage.
Figure 3B:
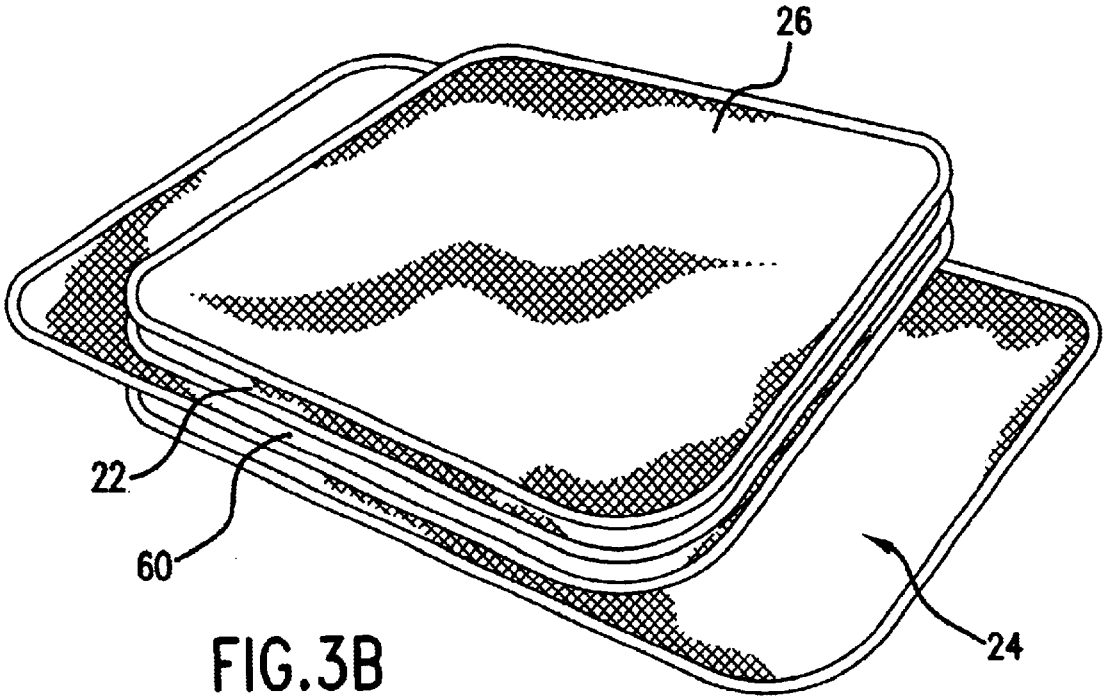
Figure 3C:
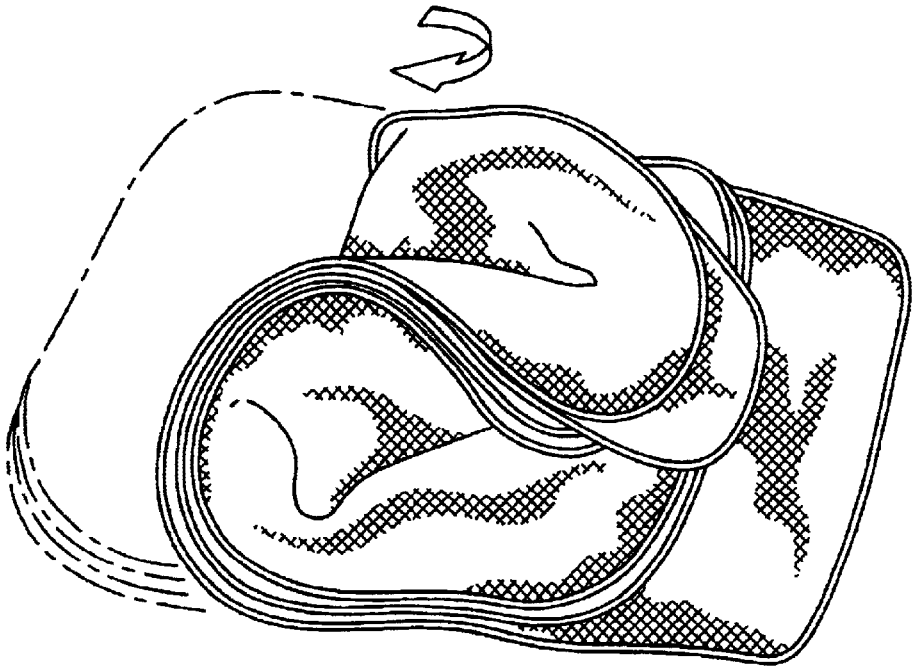
Figure 3D:
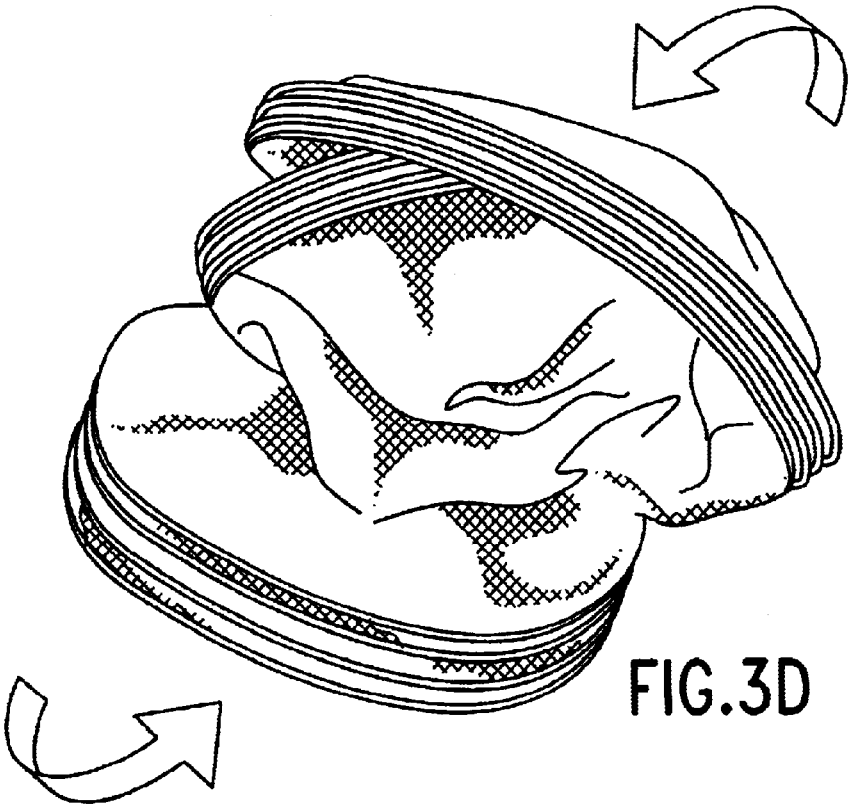
Figure 3E:
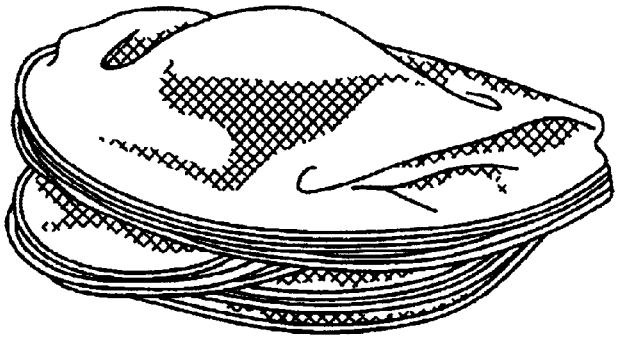

FIGS. 3A through 3E describe the various steps for folding and collapsing the structure 20 of FIG. 1 for storage. If panel 60 is removable, it can be first removed. Otherwise, the removable attachment mechanisms 70, 72 can be detached, and as shown in FIG. 3A, the first step consists of pushing in the panel 60 about its hinged connection at its side 66 so that the panel 60 is positioned against the rear panel 24. Then, the panels 22 and 26 are pushed towards the rear panel 24 and the panel 60 about the hinged connections such they collapse against panels 60 and 24, respectively. At this time, the structure 20 is the form of a stack of four panels 24, 60, 22 and 26, in one possible order, as shown in FIG. 3B. The stack of panels is then twisted and folded to collapse the frame members and panels into a smaller shape. In the next step shown in FIG. 3C, the opposite border 52 of the combined stack of panels is folded in upon the previous fold to further collapse the frame members with the panels. As shown in FIG. 3D, the next step is to continue the collapsing so that the initial size of the stack of panels is reduced. FIG. 3E shows the final step with the frame members and panels collapsed on each other to provide for a small essentially compact configuration having a plurality of concentric frame members and layers of the panels so that the collapsed structure 20 has a size which is smaller than the initial size of the panels.

If the panel 60 is removable and was removed, it can be placed on top of the stack of three panels 22, 24, 26, and twisted and folded together as a stack of four panels.

To re-open the structure 20 to its expanded configuration, the combined stack of panels is unfolded. The memory (i.e., spring-load) of the frame members will cause the frame members to uncoil on their own and to quickly expand the panels to their expanded configuration shown in FIG. 3B. The same principle can be applied to re-open all the other embodiments of the present invention.

Thus, the embodiments of the present invention increase the applications and utility of the collapsible structures to provide the user with an unlimited source and variety of fun and entertainment. The shapes and sizes of the panels and the structures can be varied or combined, as well as the entertainment features.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure comprising:

a first panel, a second panel, and a third panel, each panel having a foldable frame member having a folded and an unfolded orientation, with a fabric material covering internal portions of the frame member to form the panel when the frame member is in the unfolded orientation, with each panel being collapsed to a smaller size by twisting and folding its respective frame member, each of the panels further including a side;

wherein the side of the first panel is coupled to the side of the second panel; and wherein the side of the third panel is coupled to the fabric material of the second panel internal of the frame member of the second panel; and wherein each of the first and second panels having a flat configuration when the frame members for the first and second panels are in the unfolded orientation and coupled together to form the structure.

2. The structure of claim 1, wherein the side of the first panel is hingedly coupled to the side of the second panel.

3. The structure of claim 1, wherein the side of the third panel is hingedly coupled to the fabric of the second panel.

4. The structure of claim 1, wherein the third panel is coupled to the first panel.

5. The structure of claim 1, further including an amusement feature provided on the fabric material of the second panel.

6. The structure of claim 1, wherein the third panel extends parallel to a horizontal surface.

7. The structure of claim 1, wherein the side of the third panel is removably coupled to the fabric material of the second panel.

8. A collapsible structure comprising:

a first panel, a second panel, and a third panel, each panel having a foldable frame member having a folded and an unfolded orientation, with a fabric material covering portions of the frame member to form the panel when the frame member is in the unfolded orientation, each panel being collapsed to a smaller size by twisting and folding its respective frame member, each of the panels further including a side;

wherein the side of the first panel is coupled to the side of the second panel;

wherein the side of the third panel is coupled to the fabric material of the second panel; and a fourth panel having a foldable frame member having a folded and an unfolded orientation, with a fabric material covering portions of the frame member of the fourth panel to form the fourth panel when the frame member of the fourth panel is in the unfolded orientation, with the fourth panel further including a side, and the second panel further including a second side, wherein the side of the fourth panel is coupled to the second side of the second panel.

9. The structure of claim 8, wherein the third panel is coupled to the first panel and the fourth panel.

10. A collapsible structure comprising:

a first panel, a second panel, and a third panel, each panel having a foldable frame member having a folded and an unfolded orientation, with a fabric material covering portions of the frame member to form the panel when the frame member is in the unfolded orientation, each panel being collapsed to a smaller size by twisting and folding its respective frame member, each of the panels further including a side;

wherein the side of the first panel is coupled to the side of the second panel;

wherein the side of the third panel is coupled to the fabric material of the second panel; and wherein the third panel extends at an angle from a horizontal surface, with the first and second panels extending vertically from the horizontal surface.

* * * * *